United States Patent [19]

Shaffer et al.

[11] Patent Number: 4,786,258

[45] Date of Patent: Nov. 22, 1988

[54] ELECTRICAL CONNECTOR WITH SHUNT

[75] Inventors: Howard R. Shaffer, Millersburg; Brent D. Yohn, Newport, both of Pa.

[73] Assignee: AMP Incorporated, Harrisburg, Pa.

[21] Appl. No.: 49,633

[22] Filed: May 13, 1987

[51] Int. Cl.[4] ..... H01R 13/703

[52] U.S. Cl. ..... 439/188; 200/51.1

[58] Field of Search ..... 439/188, 513–516; 200/51 R, 51.09, 51.1

[56] References Cited

U.S. PATENT DOCUMENTS

| | | | |
|---|---|---|---|
| 3,275,765 | 9/1966 | Ferdon et al. | 200/51.1 |
| 3,601,760 | 8/1971 | Cairns | 339/59 |
| 3,686,619 | 8/1972 | McCardell, Jr. et al. | 339/59 M |
| 4,070,557 | 1/1978 | Ostapovitch | 200/51.1 |
| 4,179,173 | 12/1979 | Rise, III | 339/19 |
| 4,224,486 | 9/1980 | Zimmerman, Jr. et al. | 200/51.1 |
| 4,449,778 | 5/1984 | Lane | 339/143 R |
| 4,477,134 | 10/1984 | Wright | 339/17 F |
| 4,482,198 | 11/1984 | Crowley | 339/19 |
| 4,552,423 | 11/1985 | Swengel, Jr. | 339/19 |
| 4,557,542 | 12/1985 | Coller et al. | 339/59 M |
| 4,565,416 | 1/1986 | Rudy et al. | 339/59 M |
| 4,582,376 | 4/1986 | Olsson | 339/19 |
| 4,685,887 | 8/1987 | Hanning | 439/188 |

FOREIGN PATENT DOCUMENTS

| | | |
|---|---|---|
| 2082370 | 3/1970 | France . |
| 60-232674 | 11/1985 | Japan . |
| 2025711 | 7/1979 | United Kingdom . |

OTHER PUBLICATIONS

Products of Ford Motor Company, Photographs of Part Nos. E6DB14489 VA or UA, and E6DB14A468 PA.

IBM Technical Disclosure Bulletin, "Coaxial Cable to Printed Circuit Board Connector", vol. 13, No. 6, p. 1595, 11–1970.

*Primary Examiner*—Neil Abrams

*Attorney, Agent, or Firm*—Anton P. Ness

[57] ABSTRACT

An electrical connector assembly (10) includes a receptacle (12) and a plug (14) engageable with the receptacle (12) to form electrical connections between terminals (42,20) carried by the receptacle and plug. A shunt (52) in the plug (14) is in engagement with a pair of socket terminals (42) when the plug is at least partially disengaged from the receptacle; but when the connectors are fully mated, a cam post (90) on the receptacle (12) enters the plug (14) and moves and holds the shunt (52) out of engagement with the socket terminals (42). The commoning connection is broken when the plug is fully mated with the receptacle, and will become reestablished when plug (14) is or begins to become disconnected from receptacle (12).

19 Claims, 7 Drawing Sheets

26
14
52
62
42
28
88
40
24
12
20
96
90
94
50
92
102
98
20
100

ELECTRICAL CONNECTOR WITH SHUNT

FIELD OF THE INVENTION

The invention relates to an improved electrical connector including a receptacle and a plug which mate with each other to form electrical connections between groups of terminals carried by the receptacle and plug. The plug includes a bridge contact or shunt engageable with a pair of plug terminals when the plug is disengaged from the receptacle. The pair of plug terminals may be connected to a remote sensor which provides an indication when the plug is disengaged from the receptacle.

Movement of the plug into the receptacle forms initial connections between the plug and receptacle terminals and then moves the shunt away from the pair of plug terminals to break the connection, deactivate the sensor and thereby provide a remote indication that the plug and receptacle are properly mated with electrical connections formed between their respective terminals.

The invention may be used to actuate a sensor on an automobile dashboard to alert the operator that a plug and receptacle of a connector in the electrical system are improperly mated and require service. The connector may be part of an airbag safety system, and as such, it is preferred that the shunt enable sensing of not only a totally disconnected condition, but also sensing of a partially mated condition such as if the connectors are gradually becoming disconnected; to this end it is preferred that the shunt bridge the pair of terminals prior to the complete electrical disconnection of the plug's terminals from the receptacle's terminals.

The disclosed example of the invention includes a right angle receptacle carrying two staggered rows of terminals. The plug includes two staggered rows of terminals having the same spacing and separation as the terminals in the receptacle. The plug carries miniature shunts located between the rows of plug terminals and engageable with an adjacent pair of terminals in one row when the plug is disengaged from the receptacle. The receptacle carries a cantilever cam post for each shunt extending between the rows of plug terminals. When the plug is inserted into the receptacle the post extends into the plug between the shunt and a support and lifts the shunt away from the plug terminals. The support prevents deflection of the post during and after lifting of the shunt from the terminals.

An example of the invention will now be described with reference to the accompanying drawings in which.

Figure 1:
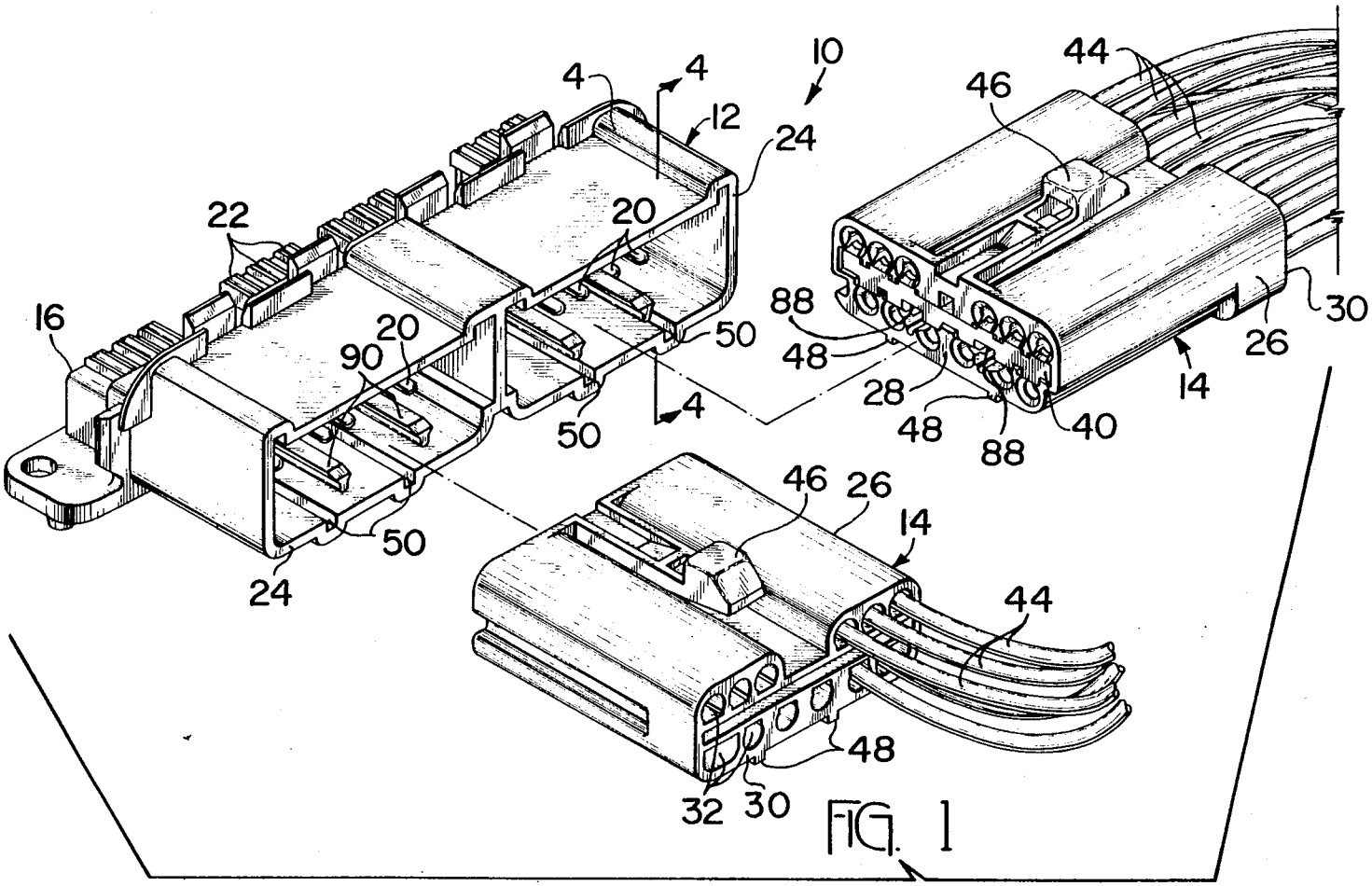
FIG. 1 is a perspective view of a connector assembly according to the invention with two plugs in position for assembly with a mating receptacle.
Figure 4A:
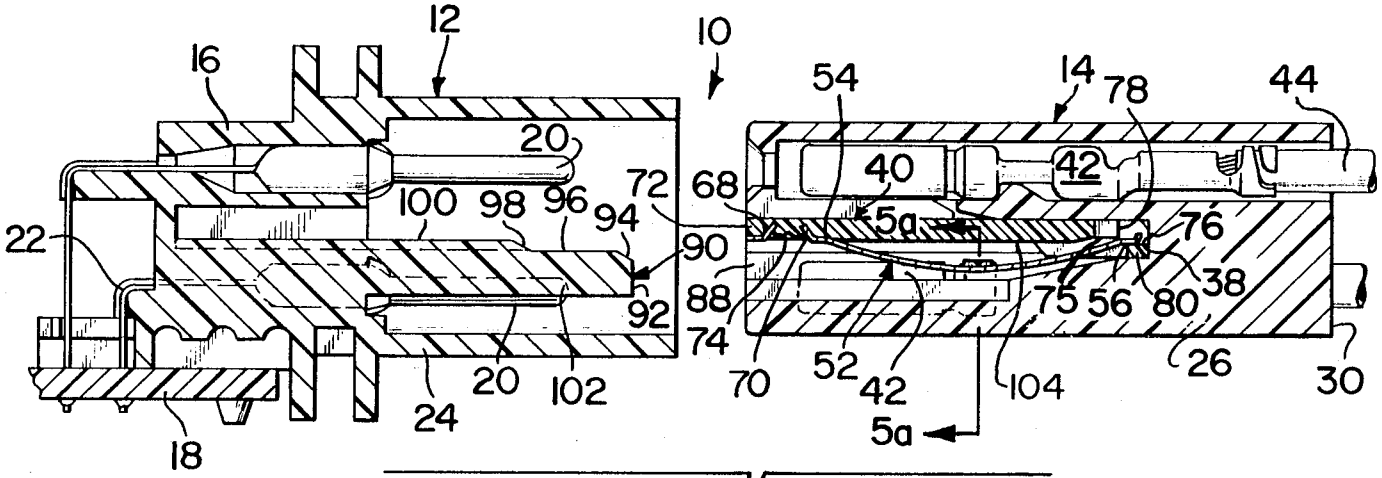
Figure 4B:
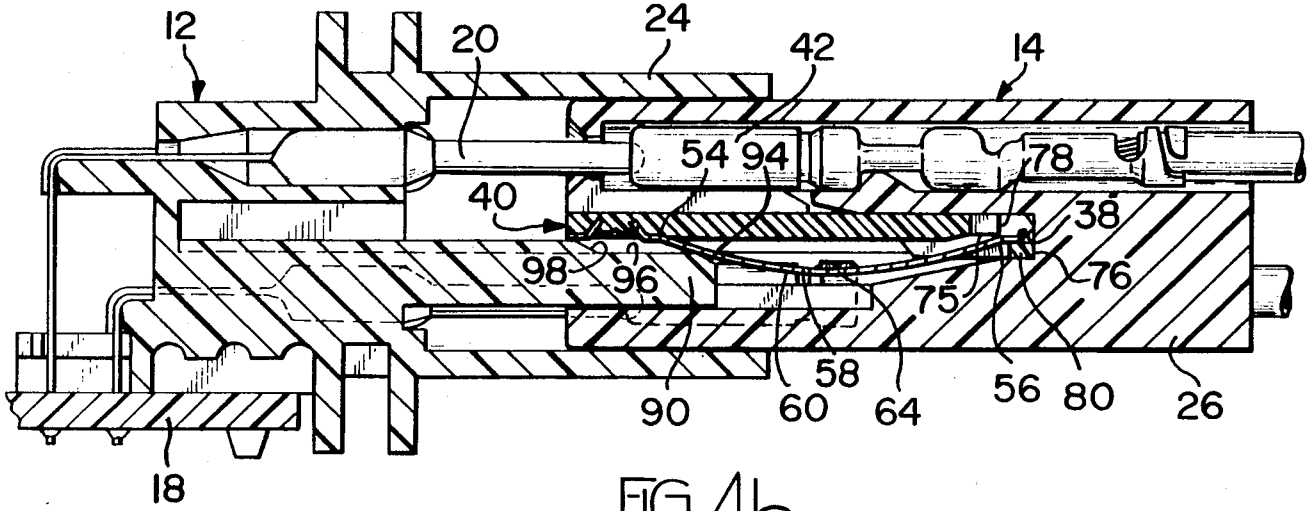
Figure 4C:
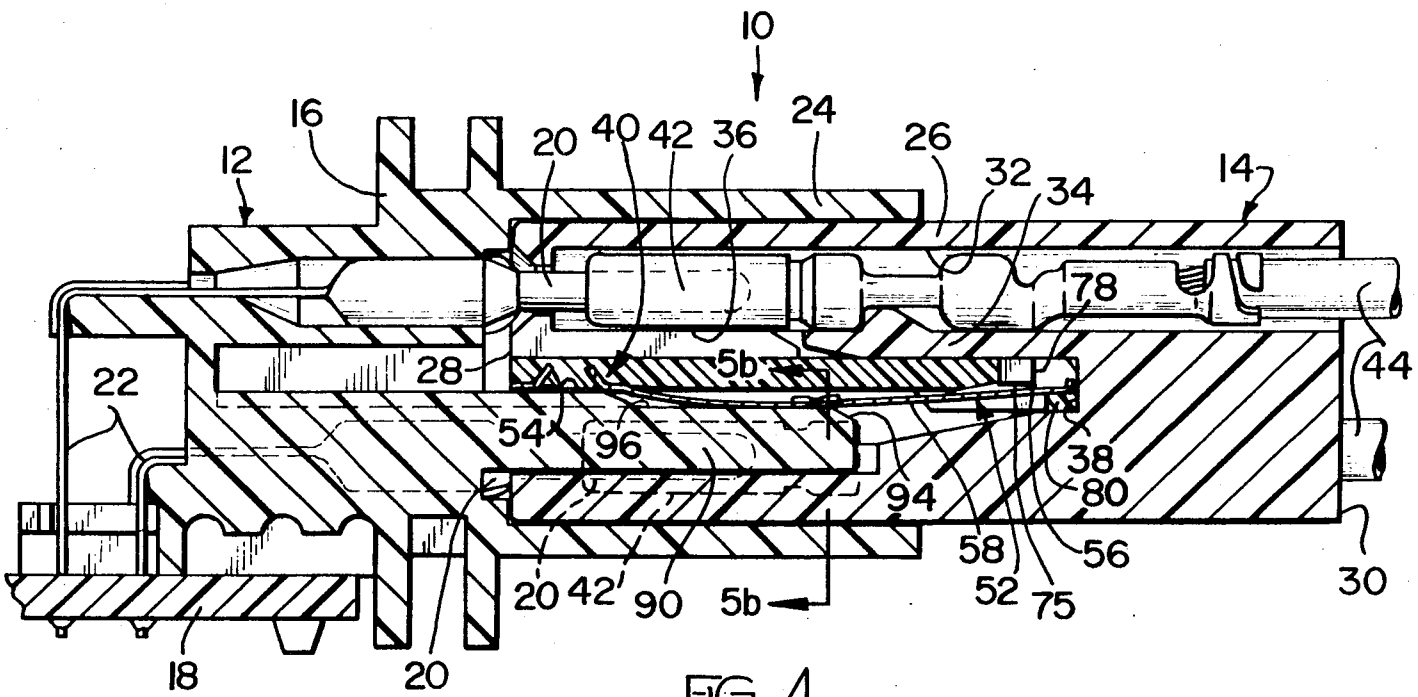

FIGS. 4*a*, 4*b* and 4*c* are sectional views taken generally along line 4—4 of FIG. 1 illustrating insertion of a plug into the receptacle.

Figure 5A:
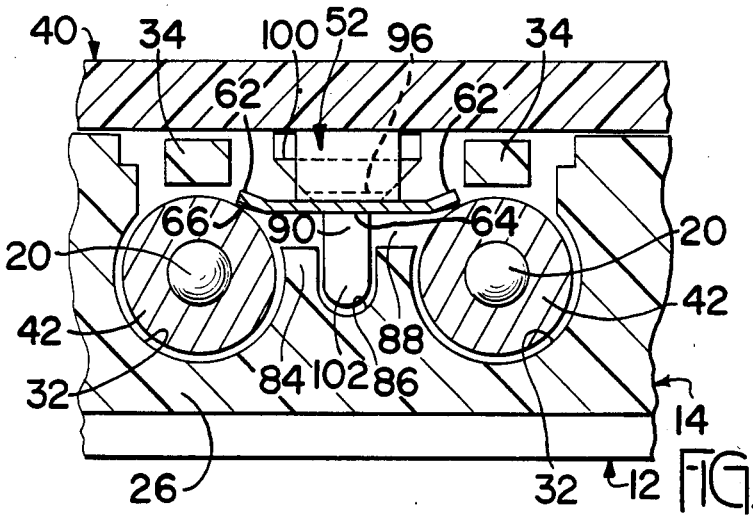
Figure 5B:
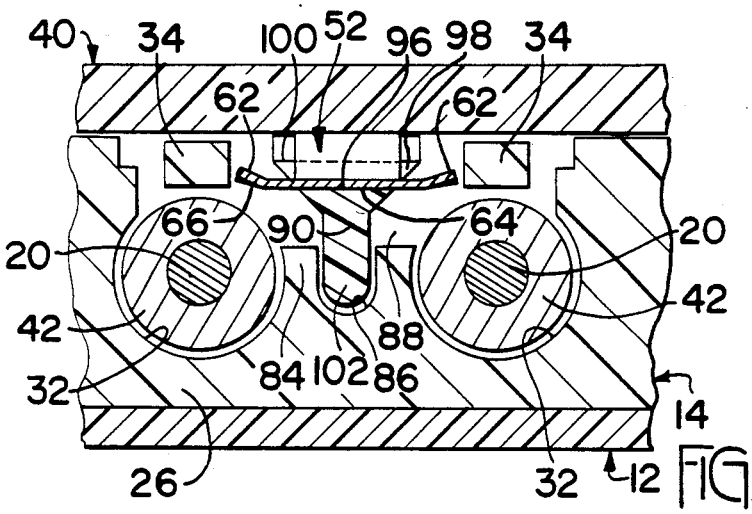

FIGS. 5*a* and 5*b* are sectional views taken respectively along lines 5*a*—5*a* and 5*b*—5*b* of FIGS. 4*a* and 4*c*.

Figure 6:
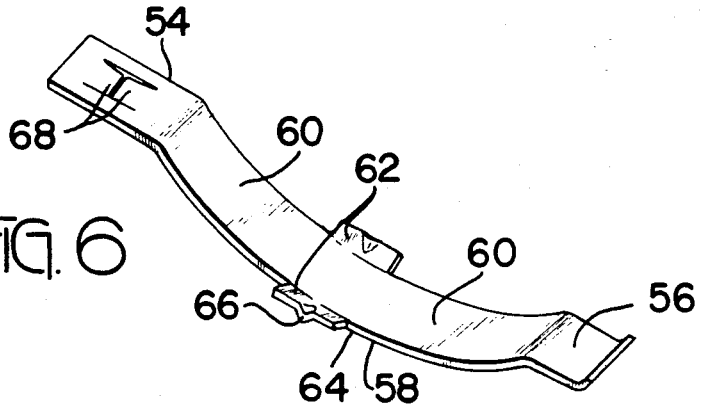

FIG. 6 is a perspective view of a shunt used in the connector assembly.

Connector assembly 10 includes a receptacle 12 and a pair of similar plugs 14 engageable with the receptacle to establish electrical connections between terminals carried in the plugs and associated terminals carried in the receptacle. Bridging contacts or shunts in each plug form electrical connections between selected pairs of adjacent plug terminals when the plug is free or partially free of the receptacle.

Receptacle 12 includes a molded plastic housing 16 adapted to be mounted on a circuit board 18 as shown in FIG. 4*a*. Housing 16 carries a plurality of pin terminals 20 projecting outwardly of the housing and joined to right angle terminal tails 22 extending rearwardly through the housing and downwardly to the circuit board 18. Pin terminals 20 are arranged in two spaced groups each including an upper and lower row of terminals with the terminals in the upper row staggered between the terminals of the lower row. The housing includes a shroud 24 surrounding each group of terminals 20.

Plug 14 includes a molded plastic housing 26 having a front face 28, a rear face 30 and a plurality of cavities 32 extending between the faces 28 and 30. The cavities 32 are arranged in two rows in the pattern of pin terminals 20 for receiving the terminals of one group upon insertion of the plug into the appropriate shroud 24. A snap latch arm 34 integral with housing 26 comprises an inner wall portion of each cavity 32. Insert-receiving aperture 36 extends across the width of the housing between the rows of cavities 32 and their respective snap latch arms 34 from front face 28 rearwardly to bottom 38. A flat, blade-like plastic insert 40 is normally fitted within aperture 36 and forms part of the housing.

Female terminals 42 are crimped onto the ends of insulated wires 44 and then moved through openings in rear face 30 of housing 26 and into cavities 32. This is done prior to fitting insert 40 into insert-receiving aperture 36. The terminals flex latch arms 34 into aperture 36 out of the path of insertion as they are moved to the forward ends of respective cavities 32 adjacent front face 28. Following positioning of the terminals, latch arms 34 snap back as shown in FIG. 4*c* to confine terminals 42 within the plug housing and secure them against axially rearward movement. Wires 44 extend away from the plug for attachment to suitable circuit members. Each plug housing 26 includes a securing means such as an integral exterior snap latch 46 engageable with a lug (not illustrated) formed on the interior surface of the appropriate shroud 24 to latching plug 14 to receptacle 12 upon mating.

The plugs may be provided with exterior polarizing ribs 48 which extend into complementary grooves 50 formed in the lower surfaces of the shrouds upon assembly. The spacing of the ribs and grooves can be different for each pair of plugs and shrouds to comprise a keying system to assure each plug fits into its appropriate shroud only.

Insert 40 carries a pair of shunts 52 shown in FIG. 6. Shunts 52 are formed from a length of flat sheet metal stock and include a fixed end 54, a free end 56 and a downwardly bowed spring 58 having legs 60 joining the ends. Wings 62 extend outwardly from the sides of central crest 64 of spring 58 and preferably include V-shaped embossments 66 on shunts 52 extending outwardly away from the contact surface. The wings and crest form a bridging element.

Figure 2:
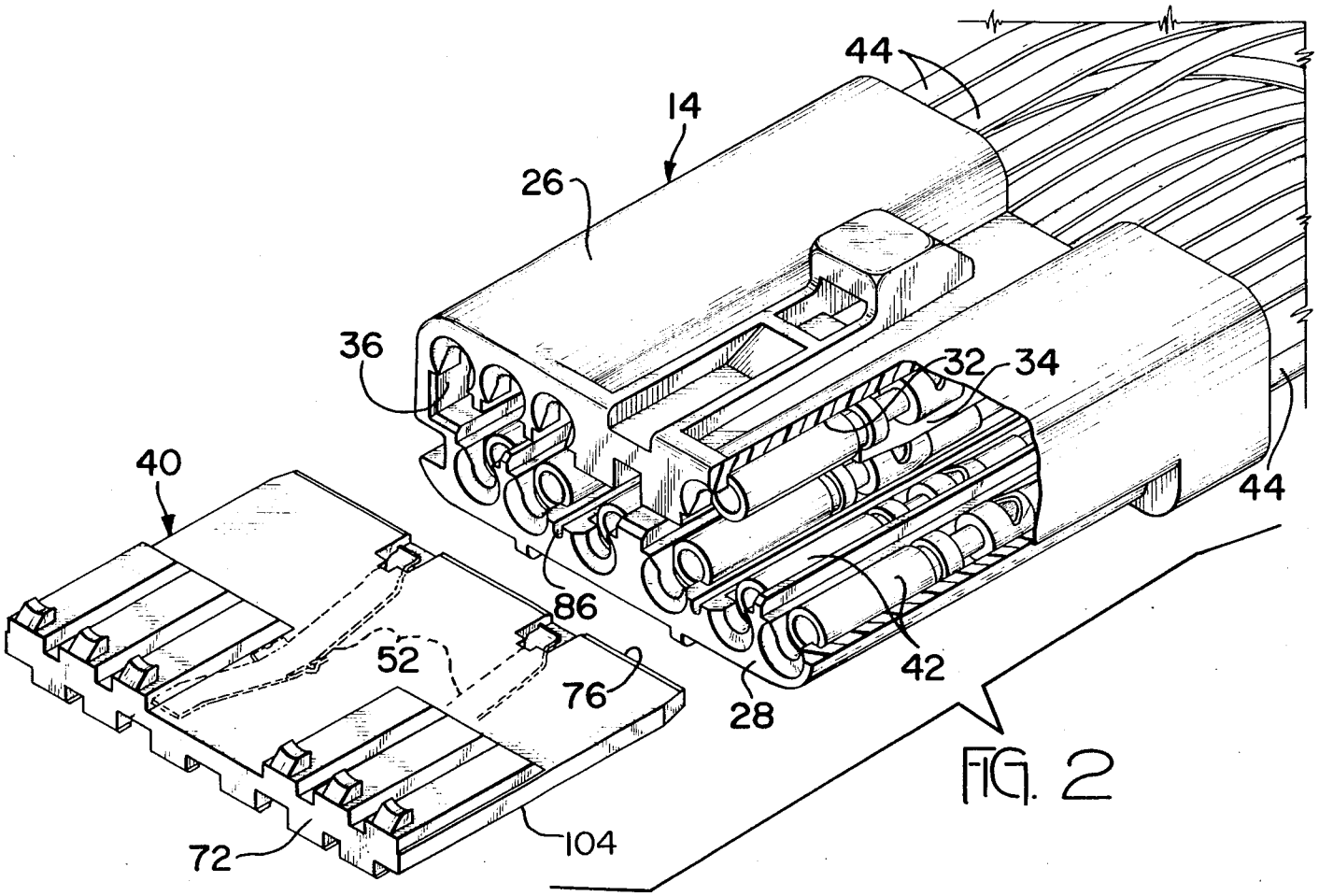
FIG. 2 is a perspective view of a disassembled plug.
Figure 3:
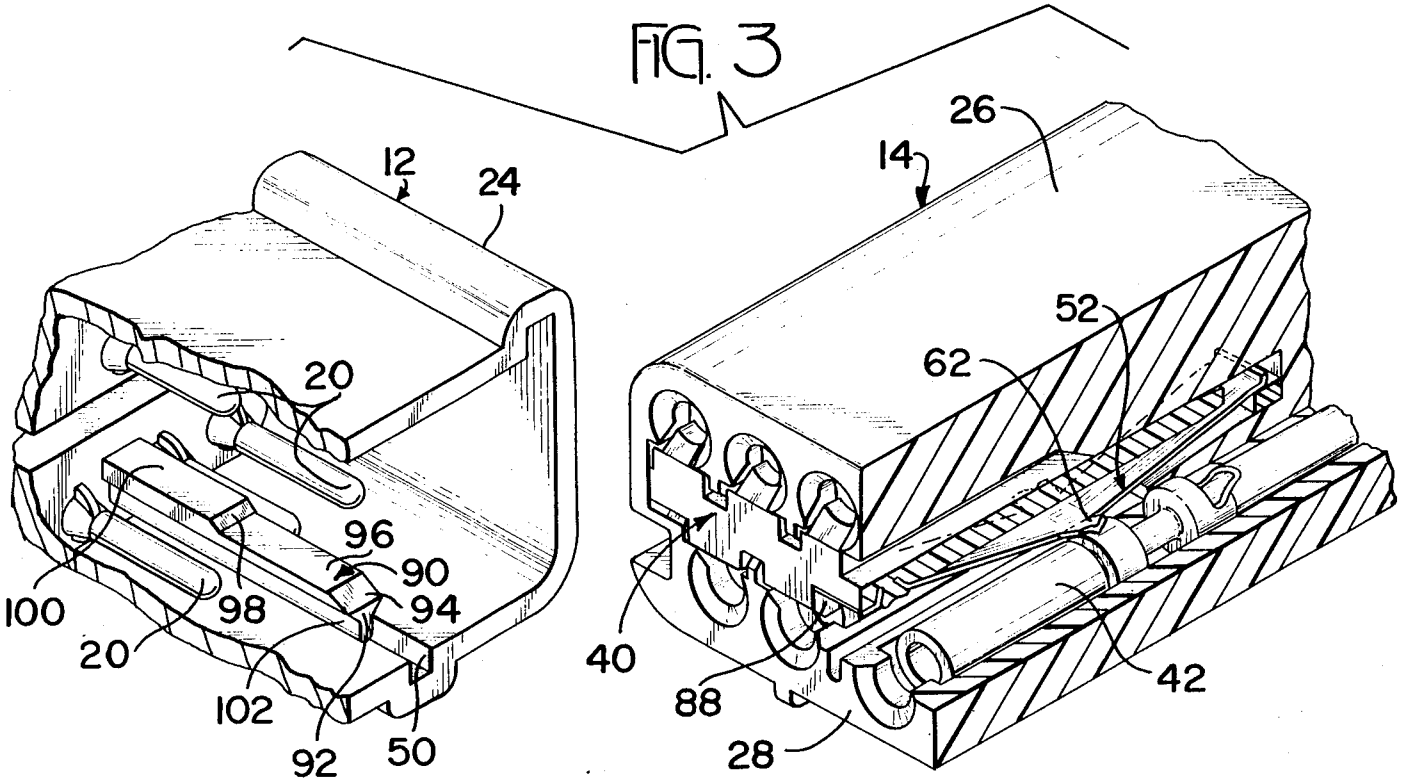
FIG. 3 is an enlarged sectional view of a part of FIG. 1.

Shunts 52 are mounted on lower surface 104 of insert 40 as shown in FIGS. 2 and 4*a* and extend along the spacer in a direction parallel to the axis of the terminals 42 in housing 26. One method of securing fixed end 54 of shunt 52 to insert 40 is described in U.S. patent application Ser. No. 049,631 filed May 13, 1987 and assigned to the assignee hereof. A pair of lock tabs 68 are formed on end 54 and are bent out from end 54 and driven into shallow recesses 70 at the trailing end 72 of insert 40 with an integral plastic boss 74 then deformed over ends of tabs 68 to hold fixed end 54 in place. Each shunt 52 is located above and between an adjacent pair of female terminals 42 in the lower row of terminals with wings 62 above the terminals. Each spring free end 56 is partially flattened, engages a bearing surface 75 proximate the lead end 76 of the insert and is confined in a relief recess 78 under bridge 80.

Alternatively, the fixed end may be secured by being inserted under a pair of detents on both sides of a recess into the insert surface to prevent movement outwardly from the insert while a forward end of an outwardly struck locking lance engages behind a stop surface to prevent movement of the fixed end outwardly along the insert surface, and the rearward recess wall can comprise a rearward stop surface to stop movement inwardly along the insert surface.

As shown in FIG. 5*a*, shunt 52 is disposed along insert 40 between latch arms 34 for terminals 42 being commoned, and the cavities 32 adjacent spring 58 extend only partially around the terminals 42 to provide openings 82 located between latch arms 34 and a longitudinal ridge 84 separating the cavities. Ridge 84 extends rearwardly from front face 28 along terminals 42. A cam support groove 86 having a rounded bottom extends along the top of the ridge 84, with a cam post-receiving opening 88 defined between ridge 84 and insert 40 between the pair of adjacent terminals 42.

FIG. 2 illustrates a partially assembled plug 14 with terminals 42 seated within cavities 32 and held in place by latch arms 34. Assembly of the plug is completed by moving lead end 76 of insert 40 with attached shunts 52 into insert-receiving aperture 36 as shown in FIG. 4*a*. The insert locks the latch arms 34 in position to prevent withdrawal of terminals 42. During insertion, the crest 64 and wings 62 of the shunts 52 ride over the tops of the pairs of adjacent terminals 42 in the lower row of terminals so that when insert 40 is fully inserted the spring 58 is partially flexed from the free position and wings 62 engage the terminals 42 as shown in FIG. 5*a*. In this position, the shunts 52 form electrical connections between the adjacent terminals 42.

The receptacle 12 includes four cantilever cam posts 90 each engageable with one of the springs 58 upon insertion of plugs 14 into the receptacle. Cam posts 90 extend forwardly of receptacle housing 16 parallel to pin terminals 20. Each post is located between two pin terminals 20 in the lower row of terminals which form electrical connections with the two female terminals 42 in the plug to either side of a ridge 84. As shown in FIG. 4*a*, the posts 90 are longer than the terminals 20.

Each post 90 includes a forward end 92, a first ramp surface 94 angling up at a shallow angle at the top of the end to a flat dwell surface 96 extending from the end of the first ramp surface 94 a distance toward the body 16. A second ramp surface 98 angles upwardly from the inner end of the dwell surface to a flat top surface 100 which extends rearwardly to housing 16. The upper surfaces of the cam post have a width equal approximately to the width of the shunt 52. A narrow rounded rib 102 extends along the bottom of the cam post from housing 16 to forward end 92. Rib 102 has a sliding fit within groove 86.

When plugs 14 are withdrawn from receptacle 12 as shown in FIG. 1 the shunt springs 58 hold wings 62 against the adjacent female terminals 42 thereby forming an electrical commoning connection between the terminals and thus between their associated wires.

Each plug is mated with the receptacle by first positioning the plug in proper alignment in front of the receptacle shroud 24 as shown in FIG. 4*a* with polarizing ribs 48 aligned with the respective polarizing grooves 50. The plug is then moved into the shroud so that forward ends 92 of cam posts 90 extend freely into cam post-receiving openings 88 above the ridges 84 with the rounded ribs 102 fitted in grooves 86. Movement of the plug toward the receptacle brings the lead ends of the female terminals 42 into contact with the tips of pin terminals 20 to form initial electrical connections between the terminals, and moves the second ramp surfaces 98 on cam posts 90 against legs 60 of springs 58 extending between the crest 64 and the fixed end 54 as shown in FIG. 4*b*.

Further movement of the plug into the receptacle fully seats the pin terminals 20 into the socket terminals 42. At the same time, second ramp surface 98 of each cam post 90 lifts and collapses a respective spring 58 so that wings 62 are moved up away from the adjacent female terminals 42 to break the electrical commoning connection between the terminals, as seen in FIG. 5*b*. During this step, the cantilever cam posts 90 are supported against deflection by ridges 84. When the plug is fully inserted as shown in FIG. 4*c*, the spring crests 64 rest on flat dwell surfaces 96 of the supported cam posts 90. Collapse of each of the springs 58 moves free end 56 thereof a short distance along a respective recess 78 beneath bridge 80 toward bottom 38 of insert-receiving aperture 36. Dwell surface 96 is spaced a sufficient distance below insert 40 to provide room for crest 64 and upwardly angled wing 62 of a spring 58 as shown in FIGS. 4*c* and 5*b*. Top surface 100 has a close sliding fit with the lower surface 104 of insert 40 and the fixed end 54 of shunt 52 to fill the space between the formerly bridged female terminals 42 with dielectric material.

After the plug has been fully inserted into the receptacle as shown in FIG. 4*c* the shunt has been removed from the connector circuitry and each of the previously bridged female terminals 42 to either side of ridge 84 forms part of an independent circuit path.

Alternatively, the bridging member may be disposed on a free end of a spring leg of a shunt which extends from a fixed end and away from the mating face of the plug connector within a cam post-receiving opening (not shown).

In some applications it may be desirable to dedicate one of each pair of female terminals 42 and its associated wire to a circuit for indicating whether the plug 14 is or is not fully mated with the receptacle 12. For instance, the wire connected to one of the pairs of terminals 42 shown in FIGS. 5*a* and 5*b* may be connected to a remote visual indicator (not shown) actuated when the shunt forms an electrical commoning connection between the female terminals. Such an application is particularly useful when the connector assembly 10 is part of a safety system and there is a need to indicate when the plug is or begins to become disconnected from the receptacle and, as a result, the safety system would be inoperative.

The connector assembly 10 may also be used in applications where a number of plugs 14 are connected in series to form part of a databus and are selectively connected to components through receptacles 12. In this application the databus remains operable through the shunts when one or more plugs is disengaged from a receptacle.

We claim:

1. An electrical connector assembly comprising first and second connector members, comprising a plug and a receptacle, the first connector member including:

a. first housing means including a mating end, b. a group of first terminals mounted in said first housing means and including at least one pair of first terminals selected to be commoned, and c. at least one shunt disposed within said first housing means and including a fixed portion and means securing said fixed portion with in said first housing means at least after assembly of said first connector member along an opening associated therewith extending inwardly from said housing mating end and extending to a said pair of first terminals to be commoned, said at least one shunt associated with a respective said pair of first terminals, each said shunt having a leg section extending into a cam-receiving opening of said first housing means from said fixed shunt portion and including a cam-engageable portion, each said shunt further having a bridging member on said leg section spring biased into engagement with said pair of first terminals across said associated opening to form an electrical commoning connection between the terminals of said pair when said first connector member is at least partially disengaged from said second connector member;

the second connector member including:

d. second housing means adapted to receive said first connector member thereinto during mating, e. a group of second terminals mounted in said second housing means and engageable with respective said first terminals to form electrical connections when said first and second connector members are mated, and f. a cam surface associated with each said shunt and adapted to engage during connector mating a said cam-engageable portion of a respective said shunt of said first connector member, whereby upon movement of said first and second connector members together, said first and second terminals engage each other to form electrical connections and said cam surface engages a respective said shunt to deflect said bridging member away from said respective pair of first terminals and break the electrical commoning connection therewith.

2. An electrical connector assembly as set forth in claim 1 wherein each said shunt includes a bowed spring extending from said fixed portion to a free end and projecting into said cam-receiving opening, said bridging member comprising a crest of said bowed spring and including wings extending laterally of said crest for engagement with said terminals of said selected pair of terminals, said free end is in sliding engagement with a bearing portion of said first housing means, and said bowed spring is adapted to be deflected away from said terminals of said selected pair upon engagement by said cam surface upon full mating of said connector members.

3. An electrical connector assembly as set forth in claim 2 wherein said shunt extends generally along the length of said cam-receiving opening with said fixed portion located adjacent the mouth of said cam-receiving opening.

4. An electrical connector assembly as set forth in claim 2 wherein said first terminals are arranged in two parallel, spaced and staggered rows, each said selected pair of first terminals is located in one said row of said first terminals and each said shunt is located between said rows of terminals.

5. An electrical connector assembly as set forth in claim 4 wherein said first housing means includes an insert member insertable and securable within an insert-receiving aperture between said two rows of first terminals, and each said shunt is secured to a surface of said insert member at a location corresponding to a said cam-receiving opening such that said bowed spring extends into said cam-receiving opening when said insert is secured in said insert-receiving aperture.

6. An electrical connector assembly as set forth in claim 1 wherein said cam surface is disposed on a cam post adjacent ones of said second terminals and aligned with a respective said shunt along a said associated opening, said associated opening is adapted to receive a said cam post therealong, said leg section of said shunt extends from said fixed portion outwardly and rearwardly into said cam post-receiving opening at least to said bridging member of said shunt disposed against said pair of first terminals, and said cam-engageable portion is forwardly of said bridging member and is engageable by a said cam post so that said leg section is deflected away from said pair of first terminals upon said cam engagement to move said bridging member out of electrically commoning engagement with said pair of first terminals during connector mating.

7. An electrical connector assembly as set forth in claim 6 wherein said first housing means includes a cam post support adjacent and facing said bridging member of each said shunt and along a respective said cam post-receiving opening between a respective said pair of first terminals being commoned by said shunt, to hold a respective said cam post against deflection upon connector mating, and said bridging member includes wings extending to either side of said cam post support, said wings engaging said pair of first terminals when said first connector member is at least partially disengaged form said second connector member.

8. An electrical connector assembly as set forth in claim 7 wherein said leg section is bowed outwardly into said cam post-receiving opening between said fixed portion and an opposed end, said bridging member is disposed across a crest of said bowed leg section, and said fixed portion and said opposed end are spaced apart along the length of said cam post-receiving opening.

9. An electrical connector assembly as set forth in claim 8 wherein a rib and groove arrangement exists between said cam post and a respective cam post support extending at least to a location adjacent said bridging member.

10. An electrical connector assembly as set forth in claim 8 wherein said means securing said shunt in said first connector member is a dielectric insert member insertable into a corresponding insert-receiving aperture of said first housing means between and along said first terminals therein, and each said shunt is secured at said fixed portion to said insert member along a surface thereof, and said opposed end is constrained to remain along said surface while permitted sliding movement along a bearing portion of said surface upon deflection of said bowed leg section.

11. An electrical connector assembly as set forth in claim 10 wherein said first terminals are arranged in two parallel, spaced and staggered rows, each said pair of first terminals to be commoned is located in one said row of terminals and each said shunt is located between said rows of terminals.

12. An electrical connector assembly as set forth in claim 10 wherein said fixed portion of each said shunt is in end located proximate the edge of said insert member proximate the mouth of said insert-receiving aperture after assembly of said first connector member.

13. An electrical connector assembly comprising first and second connector member, comprising a plug and a receptacle, the first connector member including:

a. first housing means having terminal-receiving passageways extending rearwardly from a mating end thereof and including an aperture extending inwardly from said mating end, and further including at least one cam post-receiving opening extending inwardly from said mating end and in communication with said aperture, b. a group of first terminals mounted in respective said passageways and including a pair of first terminals selected to be commoned adjacent each said at least one cam post-receiving opening and disposed in respective said passageways in communication with a respective said cam post-receiving opening, and c. a shunt associated with each said pair of terminals selected to be commoned and mounted at a fixed portion to an insert member adapted to be received into said aperture, each said shunt being so positioned that upon insertion of said insert member into said aperture each said shunt extends into each said at least one cam post-receiving opening form said fixed portion and toward a respective said selected pair of first terminals, each said shunt including a bridging member on a leg section in spring biased engagement with said respective selected pair of first terminals to form an electrical commoning connection between the terminals of said pair when said first connector member is at least partially disengaged from said second connector member;

the second connector member including:

d. second housing means having a mating end adapted to receive said first connector member thereinto during mating, e. a group of second terminals mounted on said second housing means and extending to said mating end and adapted to be engageable with respective said first terminals to form electrical connections when said first and second connector members are mated, and f. an elongate cam post associated with each said shunt of said first connector member in said second housing means adjacent ones of said second terminals and extending toward said mating end, each said cam post being substantially aligned with a respective said cam post-receiving opening of said first housing means, whereby upon movement of said first connector member into said second connector member, said first and second terminals engage each other to form electrical connections and each said cam post moves into a respective said cam post-receiving opening and engages a respective said shunt leg section to lift said bridging member away from a respective said pair of first terminals and break the electrical commoning connection therewith.

14. A shunting insert assembly for an electrical connector having a plurality of terminals at least an adjacent pair of which are disposed along an insert-receiving aperture of the connector to be commoned when the connector is not fully mated with a mating connector, comprising:

a dielectric insert adapted to be received into and secured within an insert-receiving aperture of a connector along at least one selected pair of terminals desired to be commoned; and a shunt associated with each said at least one pair of terminals to be commoned and secured along a surface of said dielectric insert at a location proximate said pair of terminals after assembly of the connector, said shunt including a fixed end joined to said dielectric insert and an opposed end not fixed to said dielectric insert, and said shunt including a deflectable section between said fixed end and said opposed end extending outwardly from said dielectric insert, said deflectable section including a bridging member spring biased after connector assembly against portions of the terminals of said selected pair of terminals to establish an electrical commoning connection therebetween.

15. A shunting insert assembly as set forth in claim 14 wherein said opposed shunt end is constrained against movement away from said insert surface while permitted movement along said insert surface upon deflection of said deflectable shunt section, and said deflectable section is bowed outwardly between said fixed and opposed ends with said bridging member disposed on a crest thereof.

16. A shunting insert assembly as set forth in claim 14 for a connector of the type having terminals retained therein by latch arms disposed along said insert-receiving aperture, wherein said dielectric insert is adapted to be disposed along said latch arms in a manner preventing unlatching after connector assembly, thereby assuring the retention of said terminals in said connector.

17. A shunting insert assembly as set forth in claim 16 wherein said deflectable shunt section after connector assembly is disposed between latch arms of said connector retaining respective terminals of said pair of terminals to be commoned, whereby said shunt does not interfere with said terminal retention nor with the prevention by said dielectric insert of unlatching thereof.

18. A shunting insert assembly as set forth in claim 14 wherein said fixed end is staked to said insert member.

19. An electrical connector assembly as set forth in claim 1 wherein said shunt leg portion extends rearwardly form said fixed portion proximate said mating end of said first connector member and into said cam-receiving opening to a free end, and said bridging member is located along said leg portion intermediate said fixed portion and said free end.

* * * * *